US008107861B2

(12) United States Patent
Uno

(10) Patent No.: US 8,107,861 B2
(45) Date of Patent: Jan. 31, 2012

(54) IMAGE FORMING APPARATUS AND IMAGE FORMING METHOD CAPABLE OF AUTOMATICALLY COLLECTING DEVELOPER FROM DEVELOPMENT DEVICE

(75) Inventor: Mugijirou Uno, Isehara (JP)

(73) Assignee: Ricoh Company, Limited, Tokyo (JP)

( * ) Notice: Subject to any disclaimer, the term of this patent is extended or adjusted under 35 U.S.C. 154(b) by 382 days.

(21) Appl. No.: 12/362,897

(22) Filed: Jan. 30, 2009

(65) Prior Publication Data

US 2009/0214267 A1 Aug. 27, 2009

(30) Foreign Application Priority Data

Feb. 22, 2008 (JP) ..... 2008-040804

(51) Int. Cl.
*G03G 15/08* (2006.01)

(52) U.S. Cl. ..... 399/257

(58) Field of Classification Search ..... 399/257
See application file for complete search history.

(56) References Cited

U.S. PATENT DOCUMENTS

| | | | | |
|---|---|---|---|---|
| 5,486,909 | A | 1/1996 | Takenaka et al. | |
| 5,489,747 | A | 2/1996 | Takenaka et al. | |
| 5,552,870 | A | 9/1996 | Murakami et al. | |
| 5,617,190 | A | 4/1997 | Takenaka et al. | |
| 5,617,191 | A | 4/1997 | Murakami et al. | |
| 5,625,438 | A | 4/1997 | Sugiyama et al. | |
| 5,625,440 | A | 4/1997 | Matsumae et al. | |
| 5,666,625 | A | 9/1997 | Komatsubara et al. | |
| 5,689,782 | A | 11/1997 | Murakami et al. | |
| 5,697,026 | A | 12/1997 | Matsumae et al. | |
| 5,708,942 | A | 1/1998 | Sugiyama et al. | |
| 5,826,144 | A | 10/1998 | Takenaka et al. | |
| 5,897,243 | A | 4/1999 | Komatsubara et al. | |
| 7,280,773 | B2 | 10/2007 | Uno | |
| 7,561,831 | B2 * | 7/2009 | Naoi et al. | 399/257 |
| 2007/0116494 | A1 | 5/2007 | Uno et al. | |
| 2007/0280742 | A1 | 12/2007 | Matsumoto et al. | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0310865 | A1 | 12/2008 | Uno et al. | |

FOREIGN PATENT DOCUMENTS

| | | |
|---|---|---|
| JP | 3-9389 | 1/1991 |
| JP | 6-230668 | 8/1994 |
| JP | 11-272062 | 10/1999 |
| JP | 2001-117365 | 4/2001 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus includes an image carrier, a development device, a developer collection device, a detector, and a controller. The image carrier carries a latent image. The development device develops the latent image into a toner image, and includes a developer carrier opposing the image carrier and carrying a developer. The developer collection device collects the developer from the development device when the development device is driven. The detector detects a state in which the developer carrier does not carry the developer. The controller starts driving the image carrier, starts driving the development device to cause the developer collection device to start collecting the developer, and stops driving the image carrier when the detector detects the state in which the developer carrier does not carry the developer, to collect the developer from the development device.

14 Claims, 6 Drawing Sheets

IMAGE FORMING APPARATUS AND IMAGE FORMING METHOD CAPABLE OF AUTOMATICALLY COLLECTING DEVELOPER FROM DEVELOPMENT DEVICE

CROSS-REFERENCE TO RELATED APPLICATIONS

The present application is based on and claims priority to Japanese Patent Application No. 2008-040804, filed on Feb. 22, 2008 in the Japan Patent Office, the entire contents of which are hereby incorporated herein by reference.

BACKGROUND OF THE INVENTION

1. Field of the Invention

Exemplary aspects of the present invention relate to an image forming apparatus and an image forming method, and more particularly, to an image forming apparatus and an image forming method capable of automatically collecting a developer from a development device.

2. Description of the Related Art

Related-art image forming apparatuses, such as copiers, facsimile machines, printers, or multifunction printers having at least one of copying, printing, scanning, and facsimile functions, typically form an image on a recording medium (e.g., a recording sheet) based on image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a recording sheet or is indirectly transferred from the image carrier onto a recording sheet via an intermediate transfer member; a cleaner then cleans the surface of the image carrier after the toner image is transferred from the image carrier onto the recording sheet; and finally, a fixing device applies heat and pressure to the recording sheet bearing the toner image to fix the toner image on the recording sheet, thus forming the image on the recording sheet.

In such image forming apparatus, a two-component developer containing both toner particles and carrier particles is automatically collected from the development device to replace the developer with a fresh developer. For example, the development device installed in the image forming apparatus automatically removes the developer degraded over time from the development device. Thereafter, the empty development device is filled with the fresh developer.

In one example of the image forming apparatus, a regulating member contacts a development sleeve, serving as a developer carrier, to scrape off any developer carried by the development sleeve, so that the scraped developer falls into a collection container.

In another example of the image forming apparatus, an outlet, which is opened and closed by a shutter, is provided in a developer circulation path of the development device. When the shutter is opened, a developer is discharged from the development device through the outlet.

In yet another example of the image forming apparatus, an outlet is provided near the developer circulation path of the development device. When a screw is reciprocally rotated forward and backward, a developer is discharged from the development device through the outlet.

In the above-described image forming apparatuses, when the developer is collected automatically from the development device, a surface of an image carrier, such as a photoconductive drum or a photoconductive belt for carrying a toner image, may be damaged, or a cleaning blade contacting the image carrier may be curled.

Specifically, when the development device is driven to automatically collect the developer from the development device while the image carrier is not driven, the developer carried by the developer carrier may slide over the image carrier intensively when the developer is not yet collected sufficiently, generating a band-shaped scratch on a part of the image carrier. The band-shaped scratch may then show up as a band-shaped image on a recording sheet.

On the other hand, when the image carrier is driven together with the development device to automatically collect the developer from the development device, another malfunction may occur. Specifically, the developer carrier hardly carries the developer after the developer is collected from the development device sufficiently, and therefore does not supply enough toner particles to the image carrier. Accordingly, toner particles may not be sufficiently supplied to an edge of the cleaning blade contacting the image carrier to remove residual toner particles adhered to the image carrier. Consequently, the cleaning blade may be curled. The curled cleaning blade may damage the image carrier or may generate secondary malfunctions, such as faulty cleaning and noise.

BRIEF SUMMARY OF THE INVENTION

This specification describes below an image forming apparatus according to an exemplary embodiment of the present invention. In one exemplary embodiment of the present invention, the image forming apparatus includes an image carrier, a development device, a developer collection device, a detector, and a controller. The image carrier carries a latent image. The development device develops the latent image into a toner image, and includes a developer carrier opposing the image carrier and carrying a developer. The developer collection device collects the developer from the development device when the development device is driven. The detector detects a state in which the developer carrier does not carry the developer. The controller starts driving the image carrier, starts driving the development device to cause the developer collection device to start collecting the developer, and stops driving the image carrier when the detector detects the state in which the developer carrier does not carry the developer, to collect the developer from the development device.

This specification describes below an image forming method according to an exemplary embodiment of the present invention. In one exemplary embodiment of the present invention, the image forming method includes starting driving an image carrier for carrying a latent image, and starting driving a development device containing a developer used for developing the latent image carried by the image carrier into a toner image, to cause a developer collection device to start collecting the developer from the development device. The image forming method further includes detecting whether or not a developer carrier opposing the image carrier carries the developer with a detector, and stopping driving the image carrier when the detector detects a state in which the developer carrier does not carry the developer. The image forming method further includes stopping driving the development device to cause the developer collection device to finish collecting the developer from the development device.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
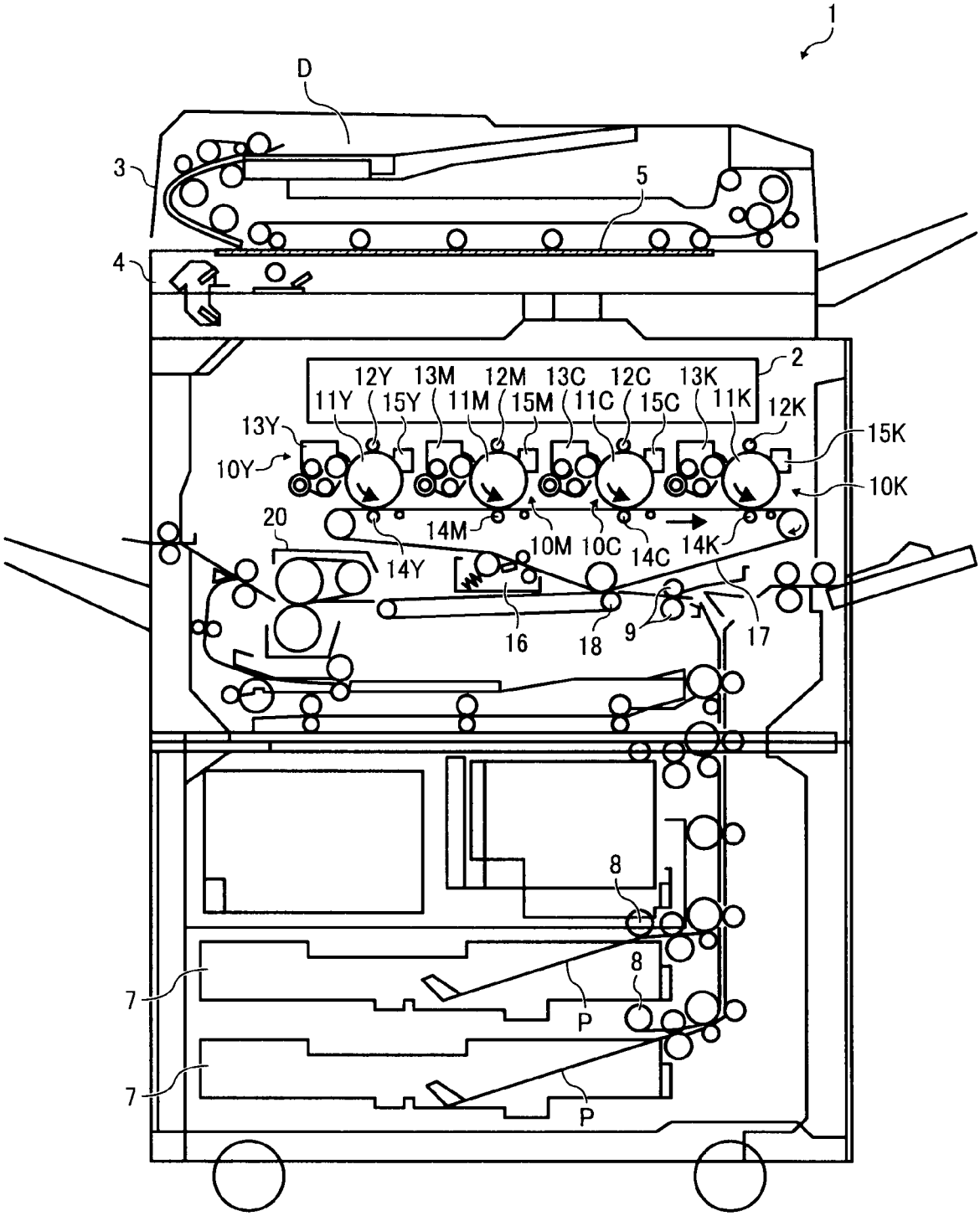
FIG. 1 is a schematic front view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

As illustrated in FIG. 1, the image forming apparatus 1 includes an original document feeder 3, an original document reader 4, a writer 2, image forming devices 10Y, 10M, 10C, and 10K, first transfer bias rollers 14Y, 14M, 14C, and 14K, an intermediate transfer belt 17, paper trays 7, feeding rollers 8, a registration roller pair 9, a second transfer bias roller 18, an intermediate transfer belt cleaner 16, and a fixing device 20.

The original document reader 4 includes an exposure glass 5.

The image forming devices 10Y, 10M, 10C, and 10K include chargers 12Y, 12M, 12C, and 12K, photoconductive drums 11Y, 11M, 11C, and 11K, development devices 13Y, 13M, 13C, and 13K, and cleaners 15Y, 15M, 15C, and 15K, respectively.

The image forming apparatus 1 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 1 functions as a tandem type color copier for forming a color image on a recording medium by electrophotography.

The original document feeder 3 feeds an original document sheet D toward the original document reader 4. The original document reader 4 reads an image on the original document sheet D sent by the original document feeder 3 to generate image data. The chargers 12Y, 12M, 12C, and 12K charge surfaces of the photoconductive drums 11Y, 11M, 11C, and 11K, serving as image carriers, respectively. The writer 2 emits laser beams onto the charged surfaces of the photoconductive drums 11Y, 11M, 11C, and 11K according to the image data generated by the original document reader 4 to form electrostatic latent images on the photoconductive drums 11Y, 11M, 11C, and 11K, respectively. The development devices 13Y, 13M, 13C, and 13K develop the electrostatic latent images formed on the photoconductive drums 11Y, 11M, 11C, and 11K to form yellow, magenta, cyan, and black toner images, respectively. The first transfer bias rollers 14Y, 14M, 14C, and 14K transfer and superimpose the yellow, magenta, cyan, and black toner images formed on the photoconductive drums 11Y, 11M, 11C, and 11K onto the intermediate transfer belt 17 to form a color toner image on the intermediate transfer belt 17. The intermediate transfer belt 17 serves as a contact member for contacting and separating from the photoconductive drums 11Y, 11M, 11C, and 11K. The cleaners 15Y, 15M, 15C, and 15K remove residual toner particles not transferred and thereby remaining on the photoconductive drums 11Y, 11M, 11C, and 11K, respectively.

The paper trays 7 load recording sheets P serving as a recording medium. The registration roller pair 9 adjusts a conveyance time for feeding a recording sheet P sent from one of the paper trays 7 toward the second transfer bias roller 18. The second transfer bias roller 18 transfers the color toner image formed on the intermediate transfer belt 17 onto the recording sheet P fed by the registration roller pair 9. The intermediate transfer belt cleaner 16 cleans the intermediate transfer belt 17. The fixing device 20 fixes the color toner image on the recording sheet P.

The image forming apparatus 1 further includes toner containers provided above the photoconductive drums 11Y, 11M, 11C, and 11K. The toner containers contain yellow, magenta, cyan, and black toner particles and supply the yellow, magenta, cyan, and black toner particles to the development devices 13Y, 13M, 13C, and 13K, respectively.

Figure 2:
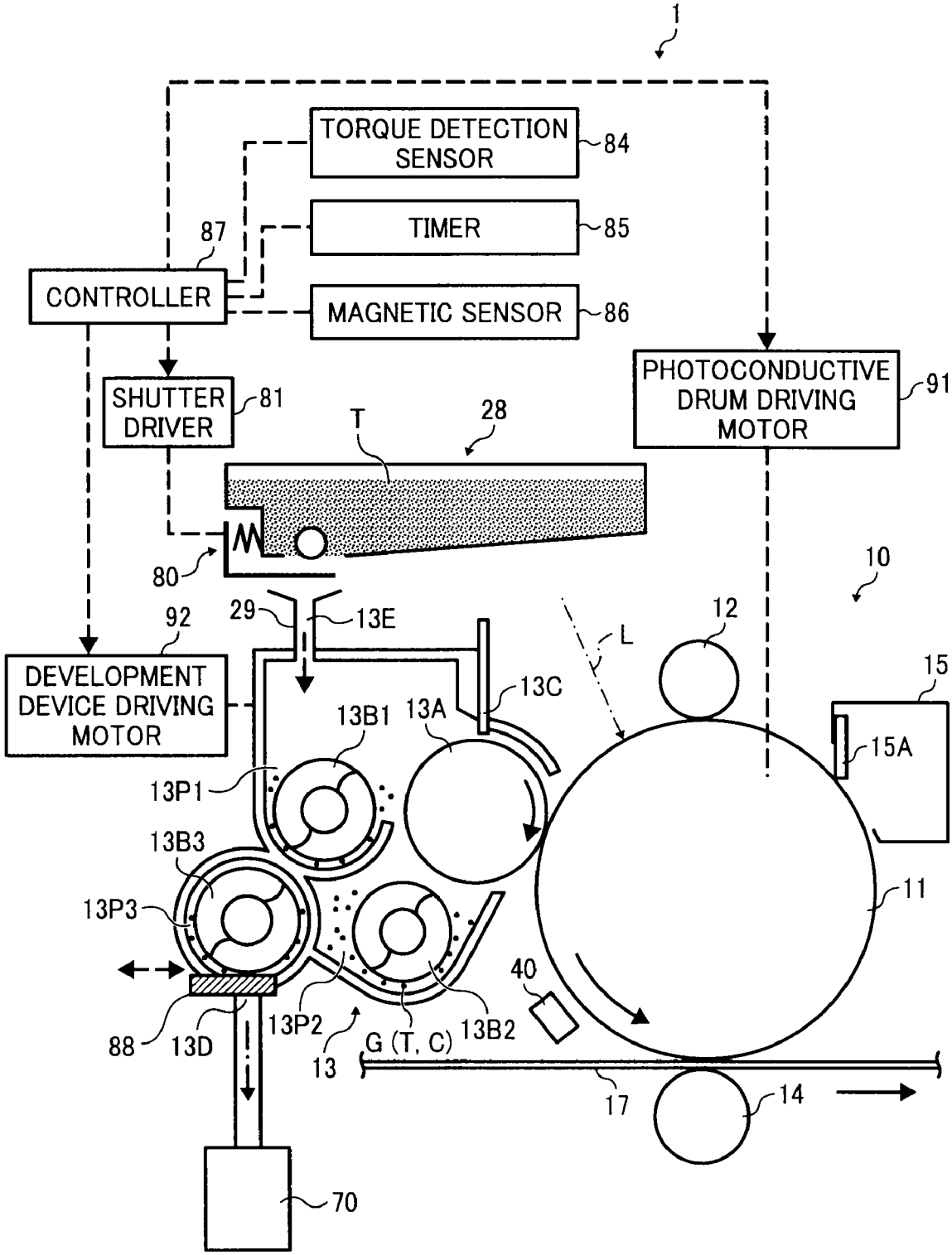
FIG. 2 is a schematic front view of an image forming device included in the image forming apparatus shown in FIG. 1.

Referring to FIGS. 1 and 2, the following describes an image forming operation for forming a color toner image on a recording sheet P, which is performed in the image forming apparatus 1. In FIG. 2, alphabetical characters, that is, "Y", "M", "C", and "K", assigned to reference numerals are omitted. For example, the image forming device 10 indicates each of the image forming devices 10Y, 10M, 10C, and 10K depicted in FIG. 1. The photoconductive drum 11 indicates each of the photoconductive drums 11Y, 11M, 11C, and 11K depicted in FIG. 1. The charger 12 indicates each of the chargers 12Y, 12M, 12C, and 12K depicted in FIG. 1. The development device 13 indicates each of the development devices 13Y, 13M, 13C, and 13K depicted in FIG. 1. The first transfer bias roller 14 indicates each of the first transfer bias rollers 14Y, 14M, 14C, and 14K depicted in FIG. 1. The cleaner 15 indicates each of the cleaners 15Y, 15M, 15C, and 15K depicted in FIG. 1.

As illustrated in FIG. 2, the image forming apparatus 1 further includes a photoconductive drum driving motor 91, a development device driving motor 92, a toner container 28, a timer 85, a magnetic sensor 86, a torque detection sensor 84, an optical sensor 40, a controller 87, a shutter 88, a shutter driver 81, a shutter mechanism 80, a supply tube 29, and a storage 70.

The development device 13 includes a first conveyance screw 13B1, a second conveyance screw 13B2, a third conveyance screw 13B3, a first conveyance path 13P1, a second conveyance path 13P2, a third conveyance path 13P3, a development roller 13A, a doctor blade 13C, an outlet 13D, and an inlet 13E. The cleaner 15 includes a cleaning blade 15A.

As illustrated in FIG. 1, in the original document feeder 3, feeding rollers feed an original document sheet D placed on an original document tray toward the exposure glass 5 of the original document reader 4. The original document reader 4 optically reads an image on the original document sheet D placed on the exposure glass 5.

Specifically, in the original document reader 4, a lamp emits light onto the original document sheet D placed on the exposure glass 5 so that the light scans the image on the original document sheet D. The light reflected by the original document sheet D enters a color sensor via mirrors and a lens to form an image in the color sensor. The color sensor reads the image into RGB (red, green, blue) lights and converts the RGB lights into electric image signals. An image processing device performs processing, such as color conversion processing, color correction processing, and space frequency correction processing, according to the electric image signals, so as to generate yellow, magenta, cyan, and black image data.

The original document reader 4 sends the yellow, magenta, cyan, and black image data to the writer 2. The writer 2 emits laser beams L depicted in FIG. 2 onto the photoconductive drums 11Y, 11M, 11C, and 11K according to the yellow, magenta, cyan, and black image data, respectively.

The four photoconductive drums 11Y, 11M, 11C, and 11K rotate counterclockwise in FIG. 1. As illustrated in FIG. 2, the photoconductive drum driving motor 91 drives and rotates the photoconductive drum 11, and serves as a drive system being independent of the development device driving motor 92 for driving the development device 13. The photoconductive drum driving motor 91 also drives and rotates the charger 12 (e.g., a charging-roller).

As illustrated in FIG. 1, in a charging process, the chargers 12Y, 12M, 12C, and 12K uniformly charge the surfaces of the photoconductive drums 11Y, 11M, 11C, and 11K at opposing positions at which the chargers 12Y, 12M, 12C, and 12K oppose the photoconductive drums 11Y, 11M, 11C, and 11K, so as to generate charge potentials on the surfaces of the photoconductive drums 11Y, 11M, 11C, and 11K, respectively. The charged surfaces of the photoconductive drums 11Y, 11M, 11C, and 11K reach irradiation positions at which the writer 2 irradiates the charged surfaces of the photoconductive drums 11Y, 11M, 11C, and 11K with laser beams, respectively.

Specifically, in an exposure process, four light sources of the writer 2 emit laser beams corresponding to image signals. The laser beams corresponding to the yellow, magenta, cyan, and black image data pass through different optical paths, respectively.

The laser beam corresponding to the yellow image data irradiates the surface of the photoconductive drum 11Y provided at a leftmost position in FIG. 1. For example, a polygon mirror of the writer 2, which rotates at a high speed, causes the laser beam corresponding to the yellow image data to scan in an axial direction (e.g., a main scanning direction) of a rotary shaft of the photoconductive drum 11Y. Thus, an electrostatic latent image corresponding to the yellow image data is formed on the surface of the photoconductive drum 11Y charged by the charger 12Y.

Similarly, the laser beam corresponding to the magenta image data irradiates the surface of the photoconductive drum 11M provided at a second-leftmost position in FIG. 1, to form an electrostatic latent image corresponding to the magenta image data. The laser beam corresponding to the cyan image data irradiates the surface of the photoconductive drum 11C provided at a third-leftmost position in FIG. 1, to form an electrostatic latent image corresponding to the cyan image data. The laser beam corresponding to the black image data irradiates the surface of the photoconductive drum 11K provided at a fourth-leftmost position, that is, a rightmost position, in FIG. 1, to form an electrostatic latent image corresponding to the black image data.

The surfaces of the photoconductive drums 11Y, 11M, 11C, and 11K bearing the electrostatic latent images reach opposing positions at which the photoconductive drums 11Y, 11M, 11C, and 11K oppose the development devices 13Y, 13M, 13C, and 13K, respectively. In a development process, the development devices 13Y, 13M, 13C, and 13K supply yellow, magenta, cyan, and black toner particles onto the photoconductive drums 11Y, 11M, 11C, and 11K to make the electrostatic latent images formed on the photoconductive drums 11Y, 11M, 11C, and 11K visible as yellow, magenta, cyan, and black toner images, respectively.

The surfaces of the photoconductive drums 11Y, 11M, 11C, and 11K bearing the yellow, magenta, cyan, and black toner images after the development process reach opposing positions at which the photoconductive drums 11Y, 11M, 11C, and 11K oppose the intermediate transfer belt 17, respectively. At the opposing positions, the first transfer bias rollers 14Y, 14M, 14C, and 14K contact an inner circumferential surface of the intermediate transfer belt 17. In a first transfer process, the first transfer bias rollers 14Y, 14M, 14C, and 14K sequentially transfer the yellow, magenta, cyan, and black toner images formed on the photoconductive drums 11Y, 11M, 11C, and 11K onto the intermediate transfer belt 17, respectively, in such a manner that the yellow, magenta, cyan, and black toner images are superimposed on the intermediate transfer belt 17 to form a color toner image.

After the first transfer process, the surfaces of the photoconductive drums 11Y, 11M, 11C, and 11K, from which the yellow, magenta, cyan, and black toner images are transferred, reach opposing positions at which the photoconductive drums 11Y, 11M, 11C, and 11K oppose the cleaners 15Y, 15M, 15C, and 15K, respectively. In a cleaning process, the cleaners 15Y, 15M, 15C, and 15K remove residual toner particles not transferred and thereby remaining on the surfaces of the photoconductive drums 11Y, 11M, 11C, and 11K from the surfaces of the photoconductive drums 11Y, 11M, 11C, and 11K, respectively. Specifically, as illustrated in FIG. 2, the cleaning blade 15A, which contacts the photoconductive drum 11, mechanically scrapes the residual toner particles adhered to the surface of the photoconductive drum 11 and collects the residual toner particles into an inside of the cleaner 15. An auger screw driven and rotated by a cleaner driving motor conveys the collected toner particles from the inside of the cleaner 15 toward an outside of the cleaner 15, so that the conveyed toner particles are collected into a waste toner bottle.

As illustrated in FIG. 1, the surfaces of the photoconductive drums 11Y, 11M, 11C, and 11K pass through discharging lamps serving as dischargers. Thus, a series of image forming processes performed on the photoconductive drums 11Y, 11M, 11C, and 11K is completed.

A recording sheet P is conveyed from one of the paper trays 7 via the registration roller pair 9 to the opposing position (e.g., a second transfer nip) at which the intermediate transfer belt 17 opposes the second transfer bias roller 18.

For example, the feeding roller 8 feeds a recording sheet P from the paper tray 7 containing recording sheets P. When the recording sheet P passes through a conveyance guide, the conveyance guide guides the recording sheet P toward the registration roller pair 9. When the recording sheet P reaches the registration roller pair 9, the registration roller pair 9 feeds the recording sheet P toward the second transfer nip formed between the intermediate transfer belt 17 and the second transfer bias roller 18 at a proper time.

An outer circumferential surface of the intermediate transfer belt 17 bearing the color toner image, which rotates clockwise in FIG. 1, reaches an opposing position at which the intermediate transfer belt 17 opposes the second transfer bias roller 18. In a second transfer process, the color toner image carried by the intermediate transfer belt 17 is transferred onto the recording sheet P fed by the registration roller pair 9 at the opposing position at which the intermediate transfer belt 17 opposes the second transfer bias roller 18.

When the outer circumferential surface of the intermediate transfer belt 17, from which the color toner image is transferred onto the recording sheet P, reaches an opposing position at which the intermediate transfer belt 17 opposes the intermediate transfer belt cleaner 16, the intermediate transfer belt cleaner 16 collects residual toner particles not transferred and thereby adhered to the outer circumferential surface of the intermediate transfer belt 17. Thus, a series of transfer processes performed on the intermediate transfer belt 17 is completed.

A conveyance belt conveys the recording sheet P bearing the color toner image toward the fixing device 20. In the fixing device 20, a fixing belt and a pressing roller fix the color toner image on the recording sheet P at a fixing nip formed between the fixing belt and the pressing roller.

An output roller discharges the recording sheet P bearing the fixed color toner image to an outside of the image forming apparatus 1. Thus, a series of image forming processes is completed.

Figure 3A:
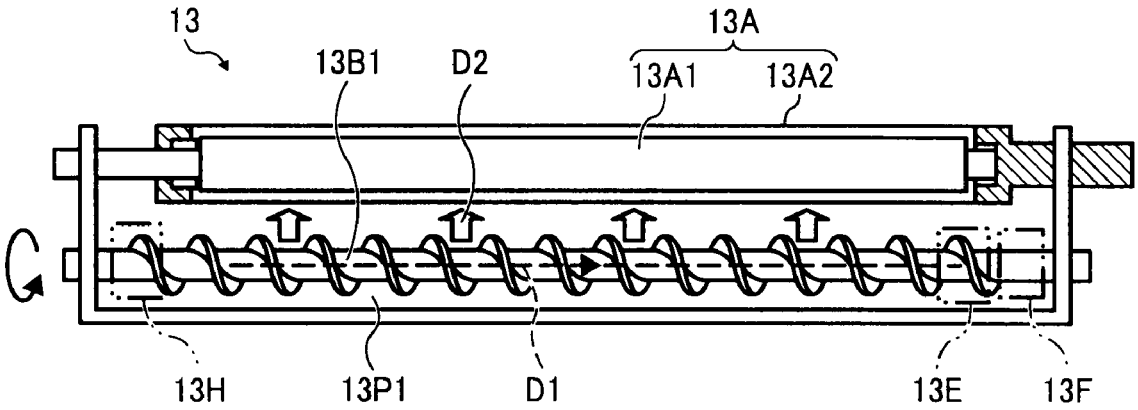
FIG. 3A is a sectional side view of an upper portion of a development device included in the image forming device shown in FIG. 2 along a longitudinal direction of the development device.
Figure 3B:
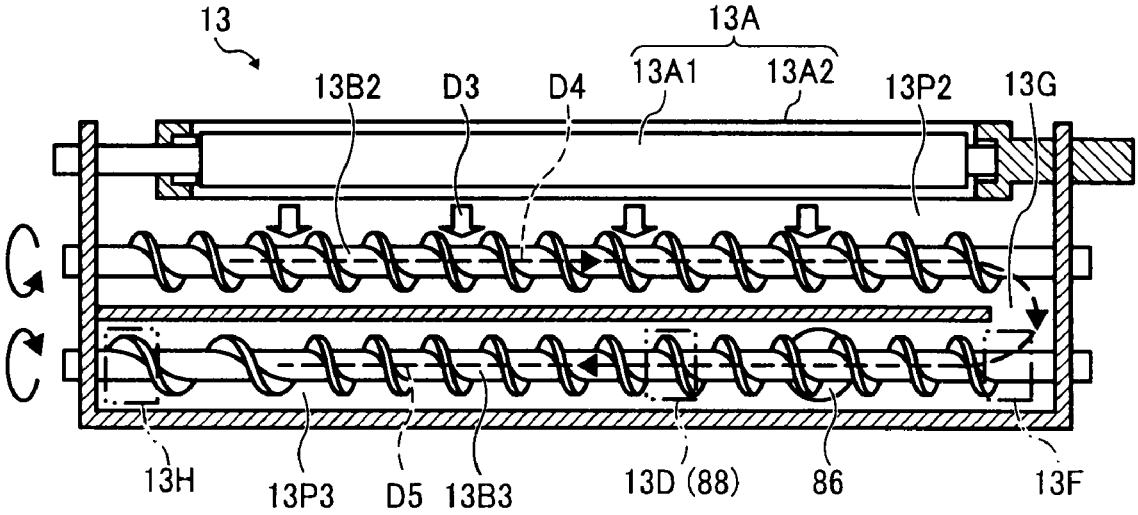
FIG. 3B is a sectional side view of a lower portion of a development device included in the image forming device shown in FIG. 2 along a longitudinal direction of the development device.
Figure 4:
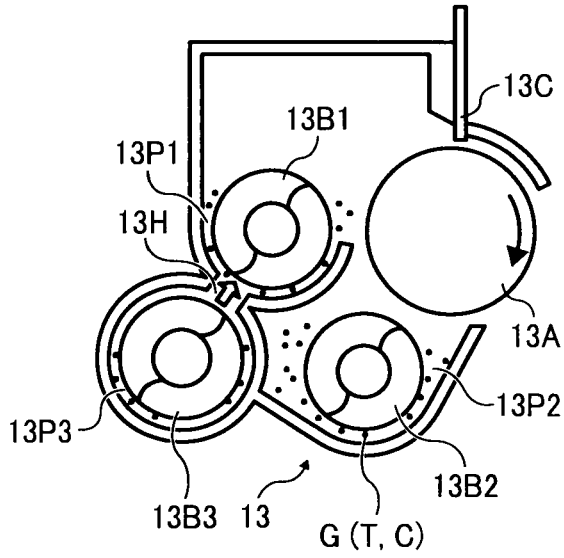
FIG. 4 is a sectional front view of one end of a development device included in the image forming device shown in FIG. 2 in a longitudinal direction of the development device.

Referring to FIGS. 2 to 4, the following describes the image forming device 10. FIG. 2 is a diagram of the image forming device 10 and the toner container 28. FIG. 3A is a sectional side view of an upper portion of the development device 13 along a longitudinal direction (e.g., an axial direction) of the development device 13. FIG. 3B is a sectional side view of a lower portion of the development device 13 along the longitudinal direction of the development device 13. FIG. 4 is a sectional front view of one end of the development device 13 in the longitudinal direction of the development device 13.

As illustrated in FIG. 3A, the development device 13 further includes a first relay portion 13F and a third relay portion 13H. The development roller 13A includes a sleeve 13A2 and a magnet 13A1.

As illustrated in FIG. 3B, the development device 13 further includes a second relay portion 13G.

The image forming devices 10Y, 10M, 10C, and 10K depicted in FIG. 1 have a substantially identical structure. The toner containers 28 (depicted in FIG. 2) corresponding to the image forming devices 10Y, 10M, 10C, and 10K, respectively, also have a substantially identical structure. Therefore, alphabetical characters, that is, "Y", "M", "C", and "K", assigned to reference numerals of the image forming devices and the toner containers are omitted in FIGS. 2 to 4.

As illustrated in FIG. 2, the image forming device 10 includes the photoconductive drum 11, the charger 12, the development device 13, and the cleaner 15.

The photoconductive drum 11, serving as an image carrier, is a negatively charged organic photoconductor. The photoconductive drum driving motor 91 drives and rotates the photoconductive drum 11 counterclockwise in FIG. 2.

The charger 12 includes an elastic charging roller in which a urethane foam layer is formed on a core metal. The urethane foam layer has a medium resistivity and includes a urethane resin, carbon black serving as a conductive particle, a sulfurizing agent, and a foaming agent. The medium resistive layer of the charger 12 may include urethane, ethylene propylene diene polyethylene (EPDM), butadiene acrylonitrile rubber (NBR), silicon rubber, a rubber material in which a conductive substance, such as carbon black and metal oxide, is dispersed in isoprene rubber and/or the like for resistance adjustment, and/or a foamed substance of the above. The charger 12 may contact the photoconductive drum 11 or may oppose the photoconductive drum 11 with a predetermined gap provided between the charger 12 and the photoconductive drum 11.

The cleaner 15 includes the cleaning blade 15A for sliding on the photoconductive drum 11 to mechanically remove and collect residual toner particles not transferred and thereby remaining on the photoconductive drum 11. The cleaning blade 15A includes a rubber material, such as urethane, EPDM, NBR, silicon, and isoprene. According to this exemplary embodiment, the cleaning blade 15A contacts the photoconductive drum 11 in a counter direction. Alternatively, the cleaning blade 15A may contact the photoconductive drum 11 in a trailing direction.

In the development device 13, the development roller 13A, serving as a developer carrier, is provided close to the photoconductive drum 11. The development roller 13A opposes the photoconductive drum 11 to form a development area in which a magnetic brush generated on the development roller 13A contacts the photoconductive drum 11. The development device 13 contains a developer G (e.g., a two-component developer) containing toner particles T and carrier particles C. The development device 13 develops an electrostatic latent image formed on the photoconductive drum 11 to form a toner image. Detailed structure and operations of the development device 13 are described below.

The toner container 28 contains toner particles T to be supplied to the development device 13 so as to replenish the development device 13 with the toner particles T corresponding to toner particles consumed by the development device 13 in the development process. Namely, the toner container 28 supplies fresh toner particles T to an inside of the development device 13 properly. Specifically, as illustrated in FIG. 3B, the magnetic sensor 86 is provided in the third conveyance path 13P3 formed by the third conveyance screw 13B3 in the development device 13, and serves as a toner density detector for detecting toner density, that is, a ratio of toner particles T contained in the developer G.

As illustrated in FIG. 2, the optical sensor 40 opposes the photoconductive drum 11, and serves as an image density detector for detecting image density of a patch pattern formed on the photoconductive drum 11 at a predetermined time. The controller 87 causes the shutter driver 81 to open and close the shutter mechanism 80 based on information about the toner density provided by the magnetic sensor 86 and information about the image density provided by the optical sensor 40.

Accordingly, toner particles T are properly supplied from the toner container 28 to the inside of the development device 13 via the supply tube 29 and the inlet 13E.

The following describes the development device 13 in detail. The development device 13 includes the development roller 13A serving as a developer carrier, three conveyance screws (e.g., auger screws), that is, the first conveyance screw 13B1, the second conveyance screw 13B2, and the third conveyance screw 13B3, and the doctor blade 13C.

As illustrated in FIG. 3A, the development roller 13A includes the sleeve 13A2 formed of a tubular non-magnetic body, such as aluminum, brass, stainless steel, and a conductive resin. The development device driving motor 92 rotates the sleeve 13A2 of the development roller 13A clockwise in FIG. 2. The magnet 13A1 is provided inside the sleeve 13A2, and forms a magnetic field to cause the developer G to ear up on an outer circumferential surface of the sleeve 13A2. For example, carrier particles C contained in the developer G ear up in a chain-like shape on the sleeve 13A2 along magnetic lines of force generated by the magnet 13A1 in a normal line. Charged toner particles T are adhered to the carrier particles C eared up in the chain-like shape to form a magnetic brush. The rotating sleeve 13A2 conveys the magnetic brush clockwise in FIG. 2, that is, in a direction identical to a direction of rotation of the sleeve 13A2.

As illustrated in FIG. 2, the doctor blade 13C is provided upstream from the development area in which the magnetic brush generated on the development roller 13A contacts the photoconductive drum 11 in the direction of rotation of the development roller 13A, and regulates the developer G on the development roller 13A to a proper amount.

The first conveyance screw 13B1, the second conveyance screw 13B2, and the third conveyance screw 13B3 circulate the developer G contained in the development device 13 in a longitudinal direction (e.g., an axial direction) of the first conveyance screw 13B1, the second conveyance screw 13B2, and the third conveyance screw 13B3 to agitate and mix the developer G.

As illustrated in FIG. 3A, the first conveyance screw 13B1 opposes the development roller 13A to convey the developer G in a horizontal direction, that is, a direction D1 shown by a rightward arrow illustrated in a broken line in FIG. 3A. Simultaneously, the first conveyance screw 13B1 supplies the developer G onto the development roller 13A in a direction D2 shown by an upward arrow illustrated in a solid line in FIG. 3A.

As illustrated in FIG. 3B, the second conveyance screw 13B2 is provided under the first conveyance screw 13B1 depicted in FIG. 3A, and opposes the development roller 13A to convey the developer G forcibly separated from the development roller 13A in a direction D3 shown by a downward arrow illustrated in a solid line in FIG. 3B due to a polarity for separating the developer G from the development roller 13A after the development process. The second conveyance screw 13B2 conveys the separated developer G in a horizontal direction, that is, a direction D4 shown by a rightward arrow illustrated in a broken line in FIG. 3B.

The third conveyance screw 13B3 is provided adjacent to the second conveyance screw 13B2 and obliquely under the first conveyance screw 13B1 depicted in FIG. 3A. The third conveyance screw 13B3 conveys the developer G sent from the second conveyance screw 13B2 to an upstream portion of the first conveyance path 13P1 (depicted in FIG. 3A) formed by the first conveyance screw 13B1. The third conveyance screw 13B3 also conveys the developer G circulated from a downstream portion of the first conveyance path 13P1 formed by the first conveyance screw 13B1 via the first relay portion 13F to the upstream portion of the first conveyance path 13P1 formed by the first conveyance screw 13B1 in a direction D5 shown by a leftward arrow illustrated in a broken line in FIG. 3B.

As illustrated in FIG. 2, rotary shafts of the first conveyance screw 13B1, the second conveyance screw 13B2, and the third conveyance screw 13B3 extend in a substantially horizontal direction like rotary shafts of the development roller 13A and the photoconductive drum 11. The development device driving motor 92 drives and rotates the development roller 13A, the first conveyance screw 13B1, the second conveyance screw 13B2, and the third conveyance screw 13B3 via gears.

As illustrated in FIGS. 3A and 3B, a wall divides the first conveyance path 13P1 formed by the first conveyance screw 13B1, the second conveyance path 13P2 formed by the second conveyance screw 13B2, and the third conveyance path 13P3 formed by the third conveyance screw 13B3.

As illustrated in FIG. 3B, a downstream portion of the second conveyance path 13P2 formed by the second conveyance screw 13B2 is connected to an upstream portion of the third conveyance path 13P3 formed by the third conveyance screw 13B3 via the second relay portion 13G. As illustrated in FIGS. 3A and 3B, the downstream portion of the first conveyance path 13P1 formed by the first conveyance screw 13B1 is connected to the upstream portion of the third conveyance path 13P3 formed by the third conveyance screw 13B3 via the first relay portion 13F. As illustrated in FIGS. 3A, 3B, and 4, a downstream portion of the third conveyance path 13P3 formed by the third conveyance screw 13B3 is connected to the upstream portion of the first conveyance path 13P1 formed by the first conveyance screw 13B1 via the third relay portion 13H. As illustrated in FIG. 4, the developer G accumulated and lifted near the third relay portion 13H in the third conveyance path 13P3 formed by the third conveyance screw 13B3 is conveyed and supplied to the upstream portion of the first conveyance path 13P1 formed by the first conveyance screw 13B1 via the third relay portion 13H.

With the above-described structure, the first conveyance path 13P1 formed by the first conveyance screw 13B1, the second conveyance path 13P2 formed by the second conveyance screw 13B2, and the third conveyance path 13P3 formed by the third conveyance screw 13B3 form a circulation path for circulating the developer G in the development device 13 in the longitudinal direction of the development device 13. For example, as illustrated in FIG. 2, when the development device driving motor 92 drives the development device 13, the development roller 13A, the first conveyance screw 13B1, the second conveyance screw 13B2, and the third conveyance screw 13B3 rotate to move the developer G contained in the development device 13 in the directions D1, D4, and D5 depicted in FIGS. 3A and 3B. In other words, a supply path for supplying the developer G to the development roller 13A (e.g., the first conveyance path 13P1 formed by the first conveyance screw 13B1 depicted in FIG. 3A) is separated from a collection path for collecting the developer G separated from the development roller 13A (e.g., the second conveyance path 13P2 formed by the second conveyance screw 13B2 depicted in FIG. 3B). Thus, density deviation of a toner image formed on the photoconductive drum 11 can be decreased.

As illustrated in FIG. 3B, the magnetic sensor 86 is provided in the third conveyance path 13P3 formed by the third conveyance screw 13B3, and serves as a toner density detector for detecting toner density of the developer G circulated in the development device 13. As illustrated in FIG. 2, a predetermined amount of toner particles T is supplied from the toner container 28 to the inside of the development device 13 via an inlet path (e.g., the supply tube 29 and the inlet 13E)

based on information about the toner density detected by the magnetic sensor 86 or information about image density detected by the optical sensor 40.

As illustrated in FIGS. 2 and 3B, the outlet 13D and the shutter 88 are provided in a bottom of the third conveyance path 13P3 formed by the third conveyance screw 13B3. When the developer G is replaced, the developer G contained in the development device 13 is discharged to an outside of the development device 13 through the outlet 13D, and is collected into the storage 70. The shutter 88 opens and closes the outlet 13D. When the developer G is not collected into the storage 70, the shutter 88 closes the outlet 13D as illustrated in FIG. 2.

When the developer G is collected into the storage 70, the shutter 88 moves to open the outlet 13D. While the development device driving motor 92 drives the development device 13 (e.g., the development roller 13A, the first conveyance screw 13B1, the second conveyance screw 13B2, and the third conveyance screw 13B3) to circulate the developer G, the developer G reaching the outlet 13D sequentially falls down under its own weight toward the storage 70 via a discharge path. Thus, according to this exemplary embodiment, the outlet 13D and the shutter 88 serve as a developer collection device for collecting the developer G from the development device 13 while the development device 13 (e.g., the development roller 13A, the first conveyance screw 13B1, the second conveyance screw 13B2, and the third conveyance screw 13B3) is driven. Accordingly, the degraded developer G, which is at the end of its useful life, can be automatically discharged and collected into the outside of the development device 13 with the relatively simple structure and operations.

According to this exemplary embodiment, the inlet 13E is provided in the first conveyance path 13P1 formed by the first conveyance screw 13B1 and the outlet 13D is provided in the third conveyance path 13P3 formed by the third conveyance screw 13B3. Alternatively, the inlet 13E and the outlet 13D may be provided at other positions, respectively.

Figure 5:
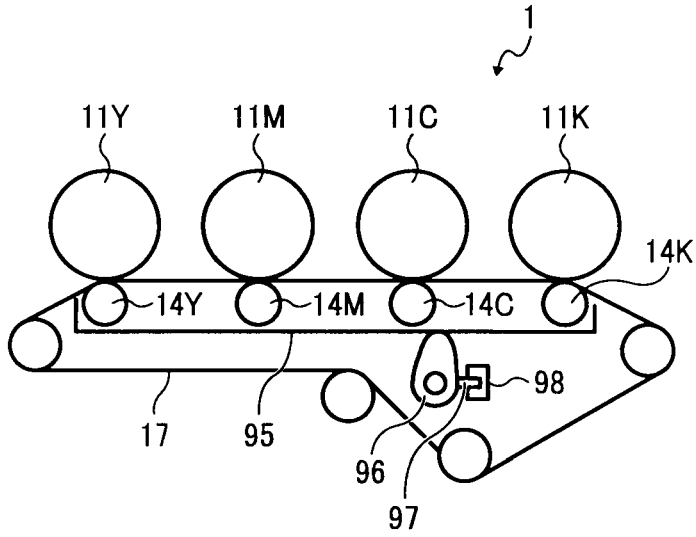
FIG. 5 is a schematic front view of an intermediate transfer belt contacting photoconductive drums included in the image forming apparatus shown in FIG. 1.
Figure 6:
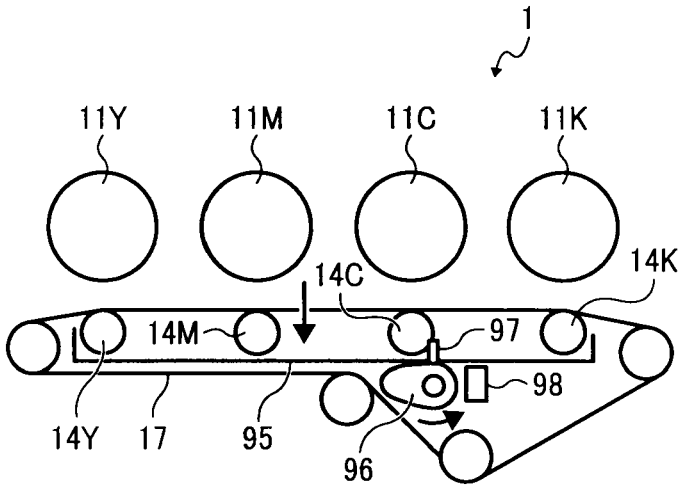
FIG. 6 is a schematic front view of the intermediate transfer belt separating from the photoconductive drums shown in FIG. 5.

Referring to FIGS. 5 and 6, the following describes a contact-separate mechanism for the intermediate transfer belt 17 of the image forming apparatus 1. The image forming apparatus 1 further includes a holder 95, a cam 96, a rotation position sensor 98, and a detection plate 97. The holder 95 and the cam 96 form the contact-separate mechanism.

The intermediate transfer belt 17 is configured to contact and separate from the photoconductive drums 11Y, 11M, 11C, and 11K. Specifically, the holder 95 rotatably holds the four first transfer bias rollers 14Y, 14M, 14C, and 14K contacting the inner circumferential surface of the intermediate transfer belt 17 serving as a contact member. A case, which holds the intermediate transfer belt 17, holds the holder 95 via the cam 96 in such a manner that the holder 95 moves up and down. With the above-described structure, a motor rotates the cam 96 by a predetermined angle to cause the intermediate transfer belt 17 to contact and separate from the photoconductive drums 11Y, 11M, 11C, and 11K.

For example, in order to form a toner image during a normal image forming operation, the cam 96 is positioned at a rotation position illustrated in FIG. 5 to cause the intermediate transfer belt 17 to contact the photoconductive drums 11Y, 11M, 11C, and 11K. By contrast, in order to collect a developer G in a developer collection mode, the cam 96 is positioned at a rotation position illustrated in FIG. 6 to cause the intermediate transfer belt 17 to separate from the photoconductive drums 11Y, 11M, 11C, and 11K.

The rotation position sensor 98 serves as a second detector for detecting that the intermediate transfer belt 17, serving as a contact member, separates from the photoconductive drums 11Y, 11M, 11C, and 11K. The rotation position sensor 98 is a photo sensor in which a gap is provided between a light-emitting element and a light-sensitive element, and detects the rotation position of the cam 96.

For example, when the detection plate 97 attached to the cam 96 is positioned between the light-emitting element and the light-sensitive element of the rotation position sensor 98 as illustrated in FIG. 5, light emitted from the light-emitting element does not reach the light-sensitive element, and the light-sensitive element outputs a predetermined value. Accordingly, the controller 87 depicted in FIG. 2 judges that the intermediate transfer belt 17 contacts the photoconductive drums 11Y, 11M, 11C, and 11K based on the value output by the light-sensitive element.

By contrast, when the detection plate 97 attached to the cam 96 is not positioned between the light-emitting element and the light-sensitive element of the rotation position sensor 98 as illustrated in FIG. 6, light emitted from the light-emitting element reaches the light-sensitive element, and the light-sensitive element outputs a predetermined value. Accordingly, the controller 87 judges that the intermediate transfer belt 17 separates from the photoconductive drums 11Y, 11M, 11C, and 11K based on the value output by the light-sensitive element.

Figure 7:
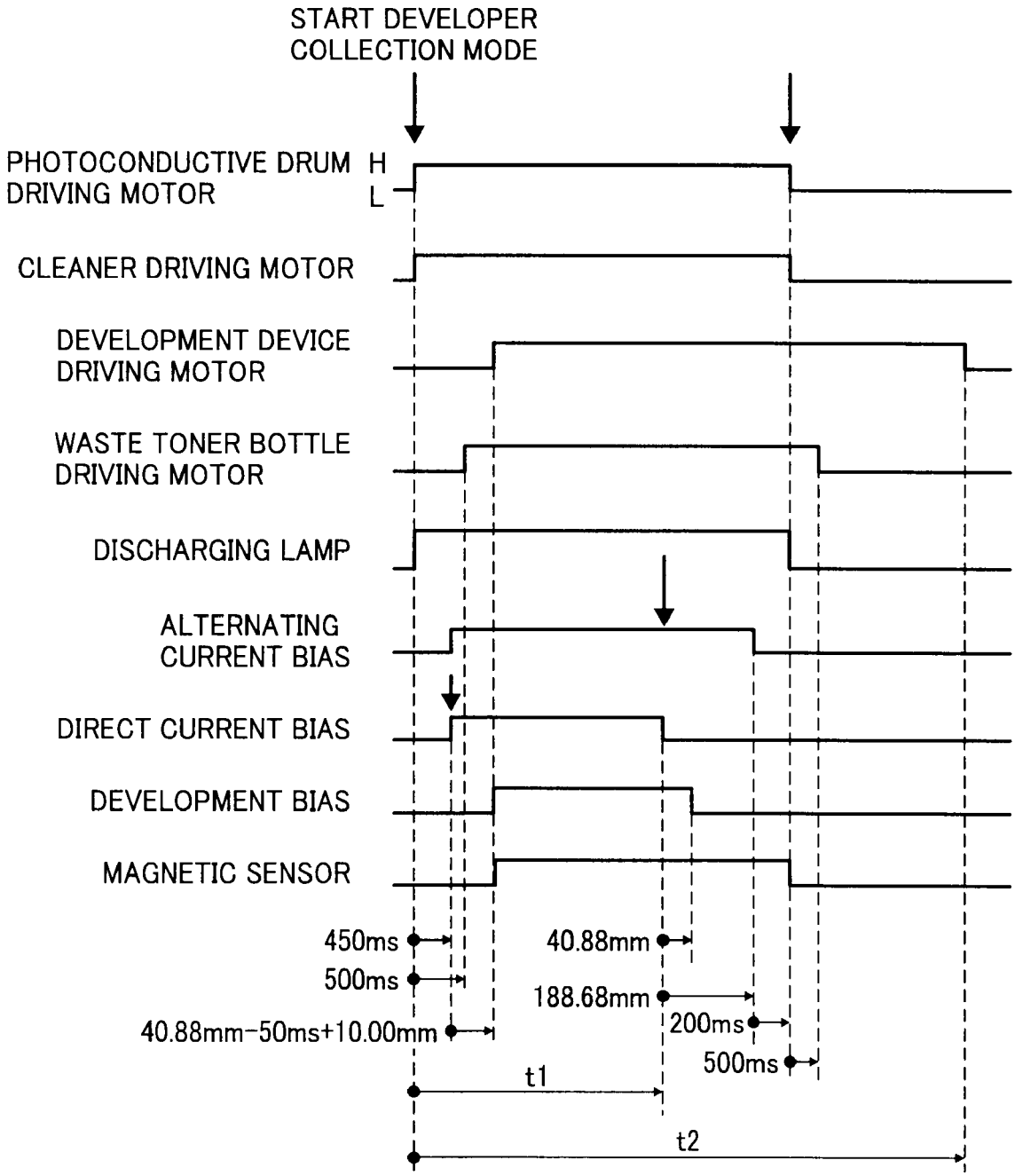
FIG. 7 is a timing chart illustrating control for collecting a developer from a development device included in the image forming device shown in FIG. 2.

Referring to FIGS. 2 and 7, the following describes control for collecting a developer G from the development device 13, that is, control performed in the developer collection mode. FIG. 7 is a timing chart illustrating such control.

According to this exemplary embodiment, a developer G is collected from the development device 13 not manually but automatically. The following describes a procedure for collecting the developer G from the development device 13.

When a service engineer or a user presses a key for commanding collection of a developer G on a control panel of the image forming apparatus 1 in a state in which the development device 13 is set in the image forming apparatus 1, the controller 87 controls the photoconductive drum driving motor 91 to start driving and rotating the photoconductive drum 11 and the charger 12. Simultaneously, a cleaner driving motor is driven and a discharging lamp is turned on. This state continues until the photoconductive drum 11 rotates stably. When the photoconductive drum 11 rotates stably, the charger 12 applies an alternating current bias and a direct current bias to the surface of the photoconductive drum 11 to charge the surface of the photoconductive drum 11. When the charged surface of the photoconductive drum 11 reaches an opposing position at which the development roller 13A opposes the photoconductive drum 11, the controller 87 controls the development device driving motor 92 to start driving and rotating the development device 13 (e.g., the development roller 13A, the first conveyance screw 13B1, the second conveyance screw 13B2, and the third conveyance screw 13B3). Further, a development bias is applied to the development roller 13A. Simultaneously, the shutter 88 is opened to discharge the developer G circulated in the development device 13 from the outlet 13D sequentially.

As described above, according to this exemplary embodiment, when automatic collection of the developer G is started, that is, when collection of the developer G has not progressed and thereby the development roller 13A carries a sufficient amount of the developer G, the controller 87 drives the development device 13 while driving and rotating the photoconductive drum 11. Accordingly, the developer G carried by the development roller 13A does not slide on a part of the photoconductive drum 11 intensively, suppressing damage to the photoconductive drum 11. For example, the developer G carried by the development roller 13A may not generate a band-shaped scratch on the surface of the photoconductive drum 11.

When collection of the developer G progresses, that is, when discharging of the developer G from the outlet 13D progresses, an amount of the developer G contained in the development device 13 decreases gradually, and in due course, the development roller 13A hardly carries the developer G. For example, a height of the developer G decreases by degrees from the downstream portion of the first conveyance path 13P1 formed by the first conveyance screw 13B1 to a height close to zero, and the developer G is not supplied from a position on the first conveyance screw 13B1 having the decreased height of the developer G onto the development roller 13A. Finally, the developer G is not supplied to a full width of the development roller 13A in a longitudinal direction of the development roller 13A.

According to this exemplary embodiment, a state in which the development roller 13A does not carry the developer G (e.g., a state in which the development roller 13A is empty of the developer G) is detected to stop driving and rotating the photoconductive drum 11. Thus, the photoconductive drum 11 does not rotate for a long time period when the development roller 13A, which does not carry the developer G, does not supply toner particles contained in the developer G to the photoconductive drum 11 and thereby no toner particles are provided between an edge (e.g., a contact portion) of the cleaning blade 15A and the photoconductive drum 11. Accordingly, the cleaning blade 15A may not be curled, suppressing damage to the cleaning blade 15A and the photoconductive drum 11, faulty cleaning, noise, and the like.

Rotation of the photoconductive drum 11 is stopped when the photoconductive drum 11 rotates for more than one cycle after application of the direct current bias is stopped and an entire circumference of the photoconductive drum 11 is discharged. When the rotation of the photoconductive drum 11 is stopped, the development bias and the alternating current bias are not applied and the discharging lamp is turned off. After the photoconductive drum 11 stops rotating, the development device 13 is driven until the developer G is completely discharged.

As described above, according to this exemplary embodiment, in order to collect the developer G from the development device 13, the controller 87 starts driving the photoconductive drum 11, and then starts driving the development device 13. Accordingly, collection of the developer G is started. When the controller 87 judges that the development roller 13A does not carry the developer G, the controller 87 stops driving the photoconductive drum 11. Consequently, damage to the photoconductive drum 11, curl of the cleaning blade 15A, and the like can be suppressed precisely.

The timer 85 detects a time period elapsed after collection of the developer G is started, and serves as a detector for detecting the state in which the development roller 13A does not carry the developer G. For example, the timer 85 counts a time period elapsed after the developer collection mode is started, that is, after driving of the photoconductive drum 11 is started. When a predetermined time period elapses, the controller 87 judges that the development roller 13A does not carry the developer G, and stops rotating the photoconductive drum 11. The predetermined time period is a fixed value determined by an experiment and simulation when the image forming apparatus 1 is developed.

The timer 85 is used for various controls performed in the image forming apparatus 1, and is not used exclusively for detecting the state in which the development roller 13A does not carry the developer G. Namely, an exclusive detector needs not be provided to detect the state in which the development roller 13A does not carry the developer G. Therefore, the above-described effects can be obtained without increasing manufacturing costs and size of the image forming apparatus 1.

Alternatively, the magnetic sensor 86, serving as a toner density detector, may be used as a detector for detecting the state in which the development roller 13A does not carry the developer G. In a normal mode, the magnetic sensor 86 functions as a toner density detector for detecting toner density of the developer G according to change in a permeability of the developer G. In the developer collection mode, the magnetic sensor 86 detects change in an amount of the developer G according to change in the permeability of the developer G, so as to detect the state in which the development roller 13A does not carry the developer G. For example, when collection of the developer G is started and a detection result provided by the magnetic sensor 86, serving as a toner density detector, reaches a predetermined value, the controller 87 judges that the development roller 13A does not carry the developer G, and stops rotating the photoconductive drum 11. The predetermined value is determined by an experiment and simulation when the image forming apparatus 1 is developed.

Alternatively, when collection of the developer G is started and a predetermined time period elapses after a detection result provided by the magnetic sensor 86, serving as a toner density detector, reaches a predetermined value, the controller 87 may judge that the development roller 13A does not carry the developer G, and may stop rotating the photoconductive drum 11.

The magnetic sensor 86 is provided to detect the toner density of the developer G contained in the development device 13, and is not used exclusively for detecting the state in which the development roller 13A does not carry the developer G. Namely, an exclusive detector needs not be provided to detect the state in which the development roller 13A does not carry the developer G. Therefore, the above-described effects can be obtained without increasing manufacturing costs and size of the image forming apparatus 1.

Yet alternatively, the torque detection sensor 84, which serves as a torque detector for detecting driving torque of the development device 13, may be used as a detector for detecting the state in which the development roller 13A does not carry the developer G. In the normal mode, the torque detection sensor 84 functions as a fault detection sensor for detecting whether or not a malfunction increases the driving torque of the development device 13. A sensor for detecting change in an electric current value supplied to the development device driving motor 92 can be used as the torque detection sensor 84. In the developer collection mode, the torque detection sensor 84 detects the state in which the development roller 13A does not carry the developer G according to decrease in the driving torque of the development device 13 caused by discharging of the developer G. For example, when collection of the developer G is started and a detection result provided by the torque detection sensor 84, serving as a torque detector, reaches a predetermined value, the controller 87 judges that the development roller 13A does not carry the developer G, and stops rotating the photoconductive drum 11. The predetermined value is determined by an experiment and simulation when the image forming apparatus 1 is developed.

Yet alternatively, when collection of the developer G is started and a predetermined time period elapses after a detection result provided by the torque detection sensor 84, serving as a torque detector, reaches a predetermined value, the controller 87 may judge that the development roller 13A does not carry the developer G, and may stop rotating the photoconductive drum 11.

The torque detection sensor 84 is provided to detect a malfunction of the development device 13, and is not used exclusively for detecting the state in which the development roller 13A does not carry the developer G. Namely, an exclusive detector needs not be provided to detect the state in which the development roller 13A does not carry the developer G. Therefore, the above-described effects can be obtained without increasing manufacturing costs and size of the image forming apparatus 1.

Yet alternatively, the optical sensor 40, which serves as an image density detector for detecting image density of a toner image formed on the photoconductive drum 11, may be used as a detector for detecting the state in which the development roller 13A does not carry the developer G. In the normal mode, the optical sensor 40 functions as an image density detector for optically detecting image density of a toner image (e.g., a patch pattern) formed on the photoconductive drum 11. The optical sensor 40 includes a light-emitting element for emitting light onto the toner image formed on the photoconductive drum 11 and a light-sensitive element for receiving light reflected by the toner image formed on the photoconductive drum 11. In the developer collection mode, the optical sensor 40 detects the state in which the development roller 13A does not carry the developer G according to decrease in the image density of the toner image (e.g., the patch pattern) formed on the photoconductive drum 11. For example, when collection of the developer G is started and a detection result provided by the optical sensor 40, serving as an image density detector, reaches a predetermined value, the controller 87 judges that the development roller 13A does not carry the developer G, and stops rotating the photoconductive drum 11. The predetermined value is determined by an experiment and simulation when the image forming apparatus 1 is developed.

Yet alternatively, when collection of the developer G is started and a predetermined time period elapses after a detection result provided by the optical sensor 40, serving as an image density detector, reaches a predetermined value, the controller 87 may judge that the development roller 13A does not carry the developer G, and may stop rotating the photoconductive drum 11.

The optical sensor 40 is provided to detect the image density of the patch pattern, and is not used exclusively for detecting the state in which the development roller 13A does not carry the developer G. Namely, an exclusive detector needs not be provided to detect the state in which the development roller 13A does not carry the developer G. Therefore, the above-described effects can be obtained without increasing manufacturing costs and size of the image forming apparatus 1.

The above-described control for collecting the developer G is performed when the contact-separate mechanism separates the intermediate transfer belt 17 from the photoconductive drums 11Y, 11M, 11C, and 11K, as illustrated in FIG. 6. Namely, the outlet 13D and the shutter 88, serving as a developer collection device, are activated when the rotation position sensor 98 depicted in FIG. 6, serving as a second detector, detects that the intermediate transfer belt 17, serving as a contact member, separates from the photoconductive drums 11Y, 11M, 11C, and 11K, as illustrated in FIG. 6.

Accordingly, the above-described control for collecting the developer G can prevent the rotating photoconductive drums 11Y, 11M, 11C, and 11K from intensively sliding on a part of the intermediate transfer belt 17, which stops rotating, in the developer collection mode, suppressing damage to the intermediate transfer belt 17. For example, the rotating photoconductive drums 11Y, 11M, 11C, and 11K may not generate a band-shaped scratch on the outer circumferential surface of the intermediate transfer belt 17. The above-described control for collecting the developer G is effectively performed especially for the intermediate transfer belt 17 manufactured at increased costs.

Alternatively, as a second detector for detecting that the intermediate transfer belt 17, serving as a contact member, separates from the photoconductive drums 11Y, 11M, 11C, and 11K, a second torque detection sensor, serving as a second torque detector for detecting driving torque of the photoconductive drums 11Y, 11M, 11C, and 11K, may be used. The second torque detection sensor may be a sensor for detecting change in a value of an electric current supplied to the photoconductive drum driving motor 91 depicted in FIG. 2. Such sensor functions as a second detector for detecting that the intermediate transfer belt 17 separates from the photoconductive drums 11Y, 11M, 11C, and 11K according to a decreased value of an electric current supplied to the photoconductive drum driving motor 91.

Yet alternatively, a position sensor for detecting a position of the intermediate transfer belt 17 may be used as a second detector for detecting that the intermediate transfer belt 17, serving as a contact member, separates from the photoconductive drums 11Y, 11M, 11C, and 11K. The position sensor may be a photo sensor for optically detecting movement of the intermediate transfer belt 17 moving up and down.

According to the above-described exemplary embodiments, the control for collecting the developer G is performed when the intermediate transfer belt 17 separates from the photoconductive drums 11Y, 11M, 11C, and 11K. Alternatively, when a contact member other than the intermediate transfer belt 17 is configured to contact and separate from the photoconductive drums 11Y, 11M, 11C, and 11K, the control for collecting the developer G may be performed when such contact member separates from the photoconductive drums 11Y, 11M, 11C, and 11K. In this case also, the control for collecting the developer G can suppress damage to the contact member while the developer G is collected.

Figure 8:
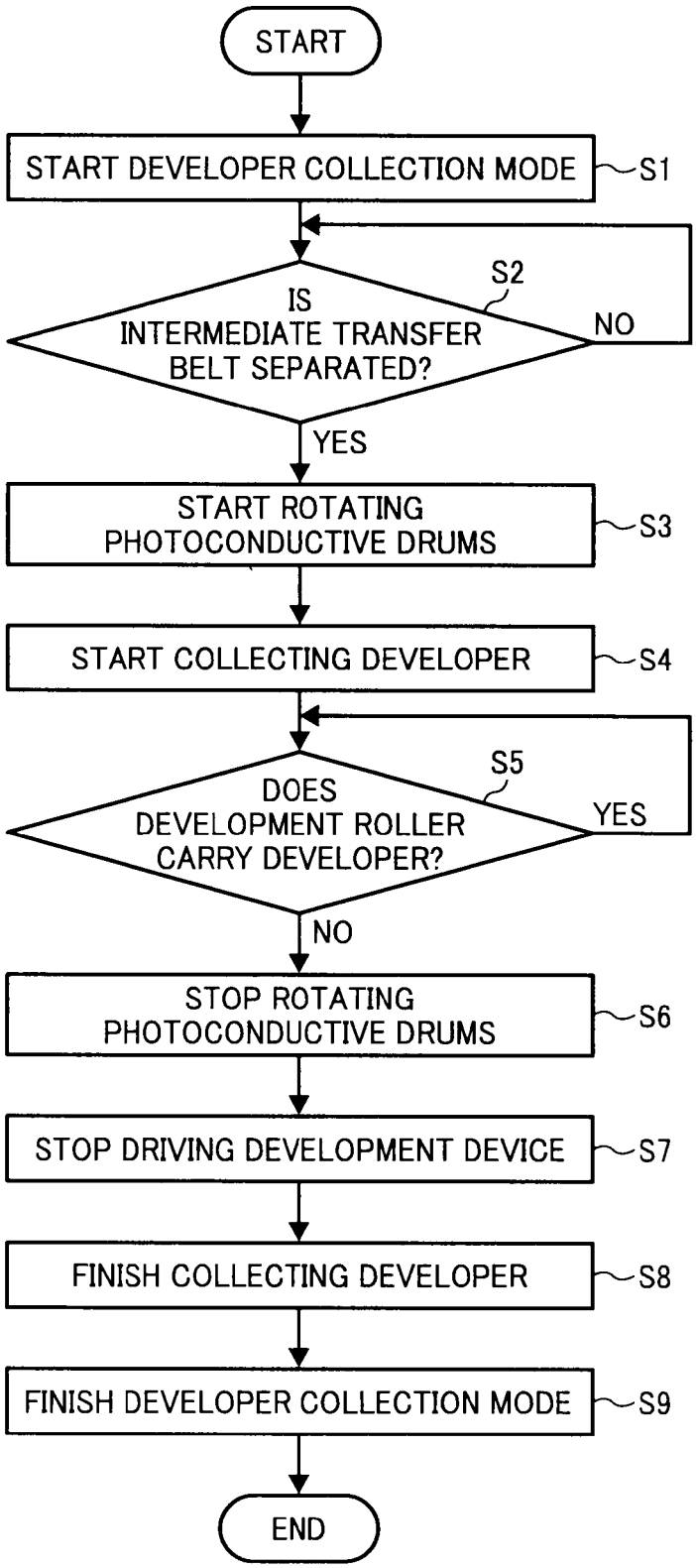
FIG. 8 is a flowchart illustrating control for collecting a developer from a development device included in the image forming device shown in FIG. 2.

Referring to FIG. 8, the following describes an example of the above-described control for collecting the developer G in detail.

When a user presses a key for commanding collection of the developer G on the image forming apparatus 1 depicted in FIG. 1, the developer collection mode starts in step S1. In step S2, the controller 87 depicted in FIG. 2 judges whether or not the contact-separate mechanism performs an operation for separating the intermediate transfer belt 17 depicted in FIG. 6 from the photoconductive drums 11Y, 11M, 11C, and 11K depicted in FIG. 6. For example, the controller 87 judges whether or not the rotation position sensor 98 depicted in FIG. 6, serving as a second detector, outputs a detection signal.

When the controller 87 judges that the contact-separate mechanism does not perform the operation for separating the intermediate transfer belt 17 from the photoconductive drums 11Y, 11M, 11C, and 11K (e.g., when NO is selected in step S2), the controller 87 does not perform the control for collecting the developer G, and step S2 is repeated.

When the controller 87 judges that the contact-separate mechanism performs the operation for separating the intermediate transfer belt 17 from the photoconductive drums 11Y, 11M, 11C, and 11K (e.g., when YES is selected in step S2), the controller 87 judges that a start of the control for collecting the developer G will not damage the intermediate transfer belt 17, and thereby starts rotating the photoconductive drums 11Y, 11M, 11C, and 11K in step S3.

In step S4, the controller 87 starts collecting the developer G. For example, the controller 87 starts driving the development device 13 depicted in FIG. 2, and the shutter 88 depicted in FIG. 2 is opened to discharge the developer G from the outlet 13D depicted in FIG. 2.

Immediately after the controller 87 starts collecting the developer G, the controller 87 judges whether or not the development roller 13A depicted in FIG. 2 carries the developer G using a detector (e.g., the timer 85, the magnetic sensor 86, the torque detection sensor 84, or the optical sensor 40 depicted in FIG. 2) in step S5. When the controller 87 judges that the development roller 13A carries the developer G (e.g., when YES is selected in step S5), step S5 is repeated. Namely, the controller 87 continues driving the photoconductive drums 11Y, 11M, 11C, and 11K and the development device 13.

When the controller 87 judges that the development roller 13A does not carry the developer G (e.g., when NO is selected in step S5), the controller 87 stops rotating the photoconductive drums 11Y, 11M, 11C, and 11K in step S6.

In step S7, the controller 87 stops driving the development device 13 when a predetermined time period elapses. In step S8, the controller 87 finishes collecting the developer G by closing the outlet 13D with the shutter 88. In step S9, the controller 87 finishes the developer collection mode.

As illustrated in FIG. 2, according to the above-described exemplary embodiments, in order to collect the developer G from the development device 13, the controller 87 starts driving the photoconductive drum 11 serving as an image carrier. Thereafter, the controller 87 starts driving the development device 13 and starts collecting the developer G. When the controller 87 judges that the development roller 13A, serving as a developer carrier, does not carry the developer G, the controller 87 stops driving the photoconductive drum 11. Thus, the developer G can be automatically collected from the development device 13 with the relatively simple structure and operations without damaging the photoconductive drum 11 and curling the cleaning blade 15A, for example.

According to the above-described exemplary embodiments, the development device 13 includes three conveyance screws, which are the first conveyance screw 13B1, the second conveyance screw 13B2, and the third conveyance screw 13B3. Alternatively, the above-described exemplary embodiments may be applied to a development device including two conveyance screws or four or more conveyance screws.

According to the above-described exemplary embodiments, the third conveyance screw 13B3 extends in a horizontal direction. Alternatively, the third conveyance screw 13B3 may extend in a direction oblique to the horizontal direction.

According to the above-described exemplary embodiments, the development device 13 is a unit detachably attached to the image forming apparatus 1. Alternatively, the above-described exemplary embodiments may be applied to an image forming apparatus including a process cartridge including the development device 13. The process cartridge may be a unit detachably attached to the image forming apparatus 1, and the photoconductive drum 11 and at least one of the charger 12, the development device 13, and the cleaner 15 are integrated into the unit.

According to the above-described exemplary embodiments, the state in which the developer carrier (e.g., the development roller 13A) does not carry the developer (e.g., the developer G) includes a state in which a slight amount of the developer remains on the developer carrier. For example, the state in which the developer carrier does not carry the developer may include a state in which the developer carrier carries the developer unevenly in a longitudinal direction of the developer carrier in an amount smaller than an amount of the developer carried by the developer carrier in the normal development process.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image carrier to carry a latent image;

a development device to develop the latent image into a toner image, comprising a developer carrier opposing the image carrier to carry a developer;

a developer collection device to collect the developer from the development device when the development device is driven;

a first detector to detect a state in which the developer carrier does not carry the developer; and a controller to start driving the image carrier if a second detector detects separation of a contact member from the image carrier, start driving the development device to cause the developer collection device to start collecting the developer, and stop driving the image carrier when the first detector detects the state in which the developer carrier does not carry the developer, to collect the developer from the development device.

2. The image forming apparatus according to claim 1, wherein the first detector comprises a toner density detector to detect toner density of the developer contained in the development device.

3. The image forming apparatus according to claim 1, wherein the first detector comprises a torque detector to detect driving torque of the development device.

4. The image forming apparatus according to claim 1, wherein the first detector comprises an image density detector to detect image density of the toner image formed on the image carrier.

5. The image forming apparatus according to claim 1, wherein the first detector comprises a timer to detect elapse of a given time period after the developer collection device starts collecting the developer.

6. The image forming apparatus according to claim 1, wherein the developer collection device comprises an outlet through which the developer is collected from the development device, provided in a circulation path to circulate the developer in the development device.

7. The image forming apparatus according to claim 1, further comprising:

a cleaning blade to contact the image carrier to remove residual toner particles adhering to the image carrier.

8. The image forming apparatus according to claim 1, further comprising:

the contact member to contact and separate from the image carrier; and the second detector to detect separation of the contact member from the image carrier.

9. The image forming apparatus according to claim 8, further comprising:

a cam to contact the contact member against and separate the contact member from the image carrier, wherein the second detector comprises a rotation position sensor to detect a rotation position of the cam.

10. The image forming apparatus according to claim 8, wherein the second detector comprises a second torque detector to detect driving torque of the image carrier.

11. The image forming apparatus according to claim 8, wherein the second detector comprises a position sensor to detect a position of the contact member.

12. The image forming apparatus according to claim 8, wherein the contact member comprises an intermediate transfer belt.

13. An image forming method, comprising:

starting driving an image carrier for carrying a latent image if separation of a contact member and the image carrier is detected;

starting driving a development device containing a developer used for developing the latent image carried by the image carrier into a toner image, to cause a developer collection device to start collecting the developer from the development device;

detecting, by a detector, whether or not a developer carrier opposing the image carrier carries the developer;

stopping driving the image carrier when the detector detects a state in which the developer carrier does not carry the developer; and stopping driving the development device to cause the developer collection device to finish collecting the developer from the development device.

14. An image forming apparatus, comprising:

an image carrier to carry a latent image;

a development device to develop the latent image into a toner image, comprising a developer carrier opposing the image carrier to carry a developer;

a developer collection device to collect the developer from the development device when the development device is driven;

a detector to detect a state in which the developer carrier does not carry the developer; and a controller to start driving the image carrier, start driving the development device to cause the developer collection device to start collecting the developer, and stop driving the image carrier when the detector detects the state in which the developer carrier does not carry the developer, to collect the developer from the development device, wherein the detector comprises an image density detector to detect image density of the toner image formed on the image carrier.

* * * * *